US006845806B2

(12) United States Patent
Gottschall et al.

(10) Patent No.: US 6,845,806 B2
(45) Date of Patent: Jan. 25, 2005

(54) ROLLER SHADE WEIGHTING ASSEMBLY

(75) Inventors: Jason Scott Gottschall, Harleysville, PA (US); Mark A. Walker, Whitehall, PA (US); Joel Elwood Hibshman, Whitehall, PA (US); David A. Kirby, Emmaus, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

(21) Appl. No.: 10/338,107

(22) Filed: Jan. 6, 2003

(65) Prior Publication Data

US 2004/0129391 A1 Jul. 8, 2004

(51) Int. Cl.[7] ..... A47G 5/02
(52) U.S. Cl. ..... 160/238; 160/368.1; 160/265
(58) Field of Search ..... 160/238, 265, 160/290.1, 262, 270, 121.1, 368.1, 121 R

(56) References Cited

U.S. PATENT DOCUMENTS

| | | | | | |
|---|---|---|---|---|---|
| 2,292,075 | A | * | 8/1942 | Hicks | 160/387 |
| 2,300,024 | A | * | 10/1942 | Terrell | 160/238 |
| 2,351,373 | A | * | 6/1944 | Thexton | 160/238 |
| 2,361,785 | A | * | 10/1944 | Mohun | 160/238 |
| 3,879,806 | A | * | 4/1975 | Armstrong | 4/610 |
| 4,344,474 | A | | 8/1982 | Berman | |
| 5,320,154 | A | | 6/1994 | Colson et al. | |
| 5,456,304 | A | | 10/1995 | Colson et al. | |
| 5,862,850 | A | | 1/1999 | Yang | |
| 5,862,851 | A | * | 1/1999 | Stoebich et al. | 160/121.1 |
| 6,324,797 | B1 | * | 12/2001 | Fago et al. | 52/222 |
| 6,598,651 | B2 | * | 7/2003 | Ehrenberger et al. | 160/238 |

FOREIGN PATENT DOCUMENTS

| | | |
|---|---|---|
| EP | 0652136 A2 | 5/1995 |
| EP | 0747562 A2 | 6/1996 |

* cited by examiner

*Primary Examiner*—Bruce A. Lev
(74) *Attorney, Agent, or Firm*—Drinker Biddle & Reath LLP

(57) ABSTRACT

A weighting assembly for a roller shade fabric includes an elongated hem bar having opposite open ends and defining an internal cavity communicating with the open ends. A spline secured to an end of the fabric is slidingly received in a pocket defined within the cavity through one of the ends. The pocket includes an opening communicating with the rest of the cavity for passage of the fabric to an exterior through an elongated slot in the hem bar. After the fabric is wrapped on an exterior surface of the hem bar, a portion of the fabric is fed into the cavity through the slot to form a loop for slidingly receiving an elongated rod through one of the ends. The rod has a diameter that is greater than a width of the slot to prevent removal of the rod through the slot.

3 Claims, 6 Drawing Sheets

ROLLER SHADE WEIGHTING ASSEMBLY

FIELD OF THE INVENTION

The present invention relates generally to roller shades having flexible shade fabrics, and more particularly to a weighting assembly engageable with the lower end of the shade fabric.

BACKGROUND OF THE INVENTION

Roller shades having a flexible shade fabric supported by an elongated roller tube are well known. The roller tube is rotatably supported to provide for winding and unwinding of the shade fabric. It is known to weight the lower end of the shade fabric to limit wrinkling of the shade fabric and to facilitate smooth operation of the roller shade as the shade fabric is wound and unwound.

It is also known to secure an elongated rod to a roller shade fabric to weight the shade fabric. The shade fabric is typically wrapped around the rod and secured to itself, by welding or stitching the shade fabric. The welding or stitching of the shade fabric, however, forms a visible seam that detracts from the appearance of the shade fabric.

SUMMARY OF THE INVENTION

According to one aspect of the invention there is provided an assembly for weighting a lower end of a roller shade fabric. The weighting assembly includes a hem bar encompassed by and securable to the shade fabric such that the hem bar is covered by an end portion of the fabric and suspended thereby to weight the fabric. The assembly further includes a securing member adapted to engage the end portion of the fabric within an interior cavity defined by the hem bar to provide attachment of the hem bar to the fabric without any visible seam.

According to one embodiment of the invention, the clamping member includes an elongated rod adapted for receipt within a loop of fabric fed into the internal cavity through an access slot. The rod is received through an open end of the hem bar and is sized to prevent removal of the rod through the access slot.

According to another aspect of the present invention, there is provided an assembly for weighting a roller shade fabric including a spline securable to an end of the shade fabric and an elongated hem bar defining an interior. The hem bar also includes a longitudinally extending slot to provide access to the interior and is adapted to receive and retain the spline within the interior. The assembly further includes a fabric clamping member located within the interior of the hem bar, the clamping member adapted for engagement with a portion of the shade fabric received within the interior through the slot.

DETAILED DESCRIPTION OF THE PREFERRED EMBODIMENTS

Figure 1:
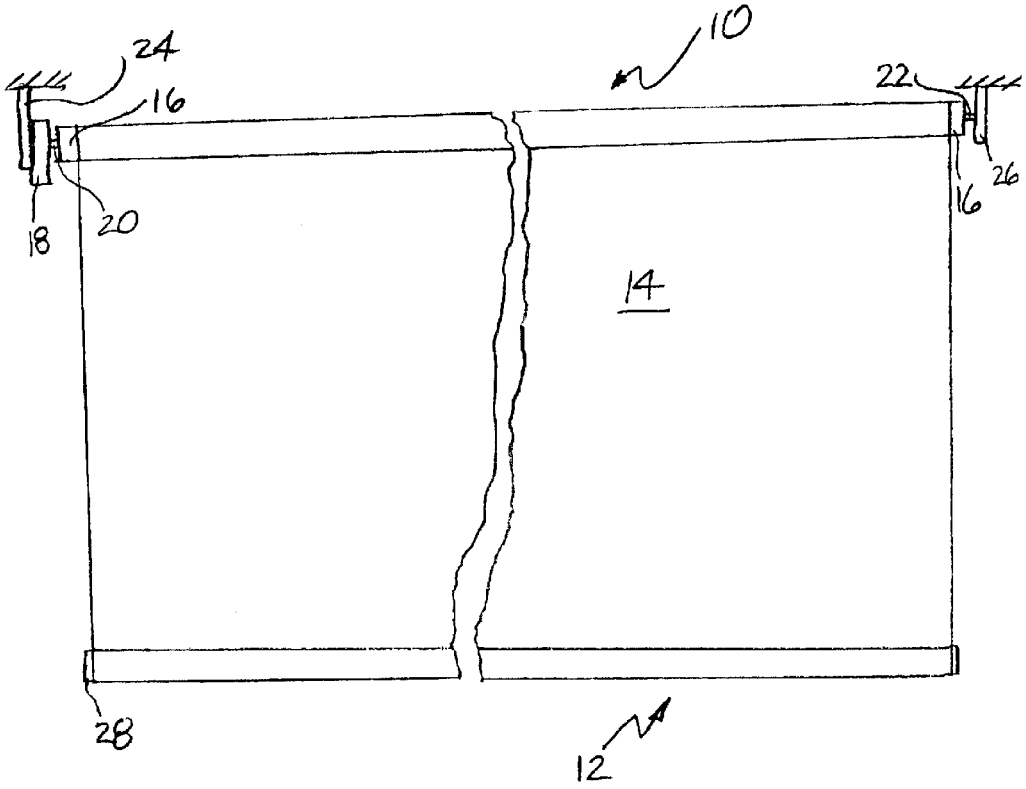
FIG. 1 is a front elevational view of a fabric weighting assembly for a roller shade according to the present invention.

Referring to the drawings, where like numerals identify like elements, there is shown in FIG. 1 a roller shade 10 having a weighting assembly 12 according to the present invention secured to a shade fabric 14. The assembly 12 weights the lower end of the shade fabric 14 to limit wrinkling of the fabric and to facilitate smooth operation of the roller shade 10 during winding and unwinding the shade fabric 14. The roller shade 10 includes an elongated roller tube 16 on which the shade fabric 14 is windingly received. In a known manner, the opposite ends of the roller tube 16 are respectively engaged by a drive shaft 20 of a motor 18 and an idler shaft 22 to provide rotatable support for the roller tube. Brackets 24, 26 connect the motor 18 and the idler shaft 22 to the ceiling of a structure, for example.

Figure 2:
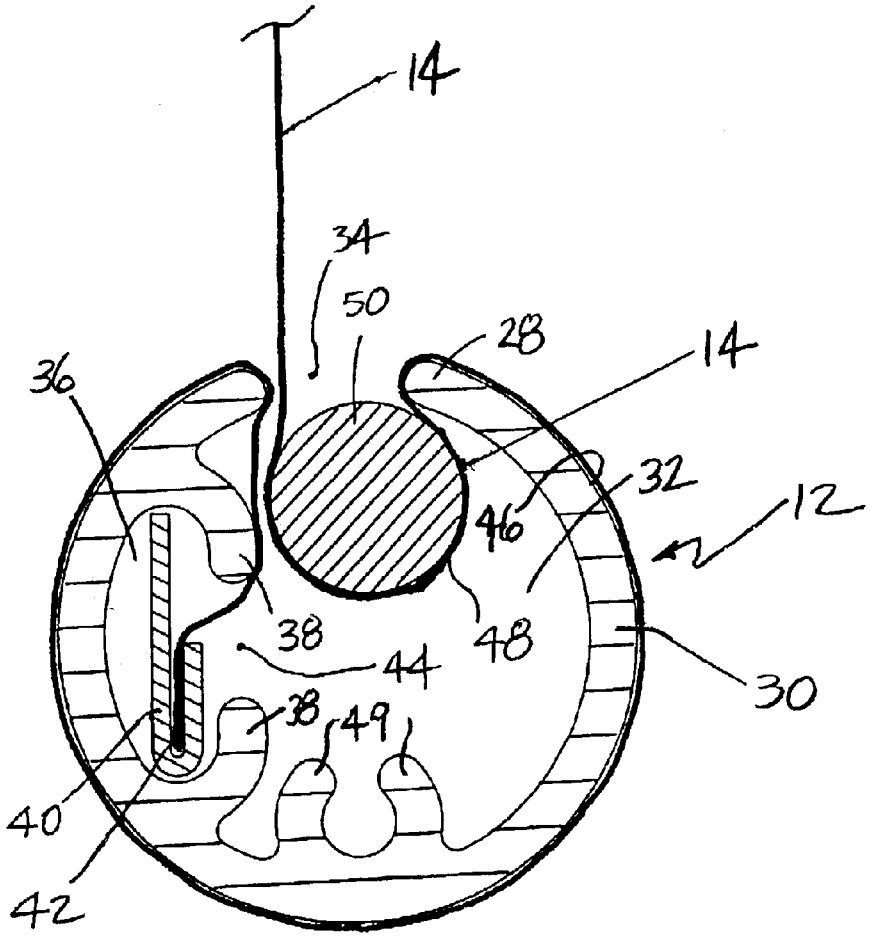
FIG. 2 is a partial sectional view of the roller shade fabric weighting assembly of FIG. 1, showing the assembly in a disengaged condition.

Referring to FIG. 2, the weighting assembly 12 of FIG. 1 is shown in greater detail. The weighting assembly 12 includes a hem bar 28 having a curved wall 30 defining an interior 32. The curved wall 30 does not enclose the interior 32, however, and includes an opening defining a longitudinally extending access slot 34. A pocket 36 is defined within the interior 32 of the hem bar 28 by members 38 that project inwardly from the curved wall 30. The weighting assembly 12 further includes a spline 40 secured to the shade fabric 14, for example, by crimping a metal strip onto a terminal end 42 of the fabric.

Figure 4:
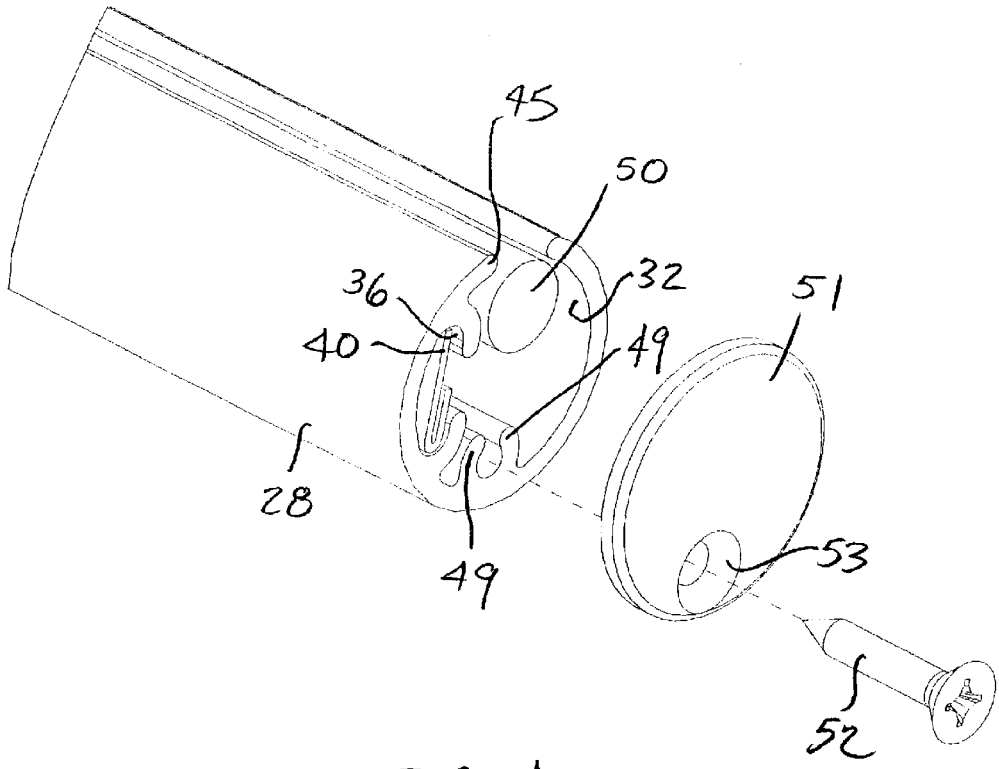
FIG. 4 is an exploded perspective view of an end cap for closing the open end of the hem bar of the weighting assembly of FIGS. 1–3.

As shown in FIG. 2, the spline 40 is contained within the pocket 36 of the hem bar 28. The members 38 define an opening 44 that provides for passage of the shade fabric 14 between the pocket 36 of the hem bar 28 and the rest of the interior 32. The width of the opening 44 is sufficiently narrow, however, to prevent the spline 40 from coming out of the pocket 36. The ends 45 of the hem bar 28, as shown in FIG. 4, are open to provide for receipt of the spline 40 in the interior 32 within the pocket 36. The spline 40 and shade fabric 14 are slidingly received through one of the ends of the hem bar 28 with the shade fabric 14 extending to the exterior of the hem bar 28 from the pocket 36 via the openings 44 and 34, respectively.

After receipt of the spline 40 and shade fabric 14 by the hem bar 28, the shade fabric is wrapped around an exterior surface 46 of the hem bar 28 as shown in FIG. 2. The present invention provides for attachment of the shade fabric 14 to the hem bar 28 in the wrapped condition shown in FIG. 2 without formation of a seam line, as would be formed, for example, by welding or stitching the shade fabric to itself in a conventional manner. With the shade fabric 14 wrapped around the exterior of the hem bar 28, the fabric is fed back into the interior 32 of the hem bar 28 through the access slot 34 to form a loop 48. The hem bar 28 is supported during this stage of the assembly to provide for formation of the fabric loop 48 within the hem bar interior 32. An elongated rod 50 is slidingly received by the fabric loop 48 through one of the ends of the hem bar 28. The diameter of the rod 50 is greater than the width of the access slot 34.

Figure 3:
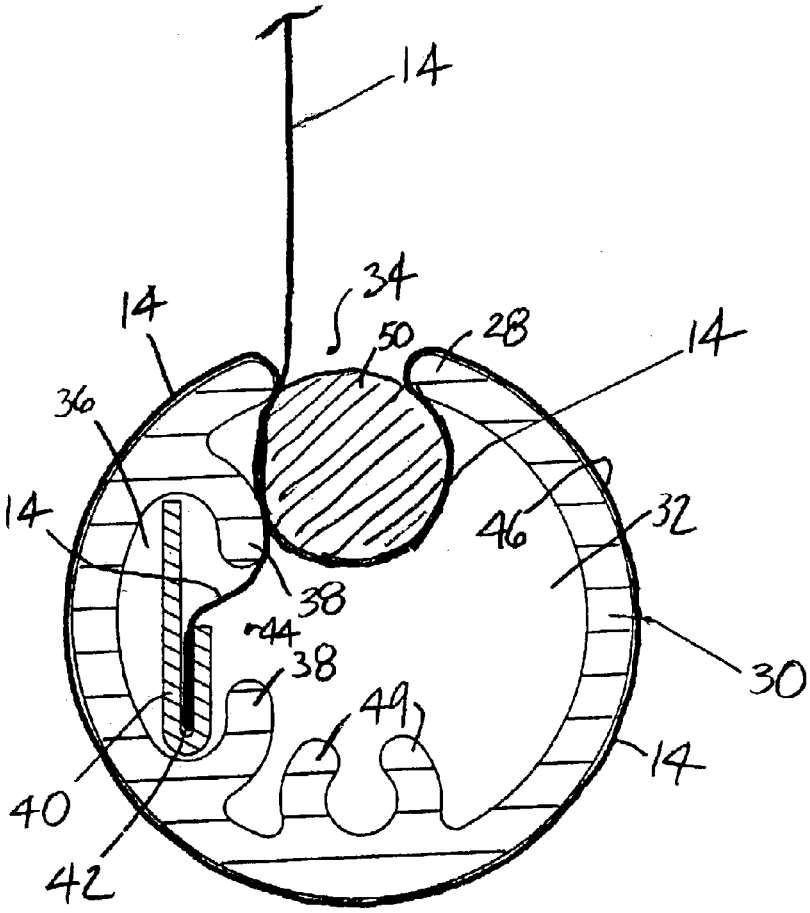
FIG. 3 is a partial sectional view of the roller shade fabric weighting assembly of FIG. 1 showing the assembly in an engaged condition.

Following the sliding receipt of the rod 50 by the fabric loop 48 within the interior 32 of the hem bar 28, the weighting assembly 12 is ready for release to hang freely from the lower end of the shade fabric 14 to weight the fabric. Upon release of the assembly 12, the hem bar 28 will move downwardly relative to the position of the hem bar shown in FIG. 2. As the hem bar 28 is lowered, the fabric loop 48 draws the elongated rod 50 toward the access slot 34. Contact between the rod 50 and the relatively narrow access slot 34, as shown in FIG. 3, restrains the hem bar 28 against further downward movement. The weight of the freely hanging hem bar 28 serves to urge the rod 50 against the access slot 34 thereby securing the shade fabric 14 to the hem bar 28 in the wrapped condition.

In addition to providing the advantage of a seamless attachment, in contrast to prior weighting assemblies having stitched or welded fabrics, the present invention provides the additional advantage of ready disassembly for removal of the weighting assembly from the roller shade fabric.

Figure 5:
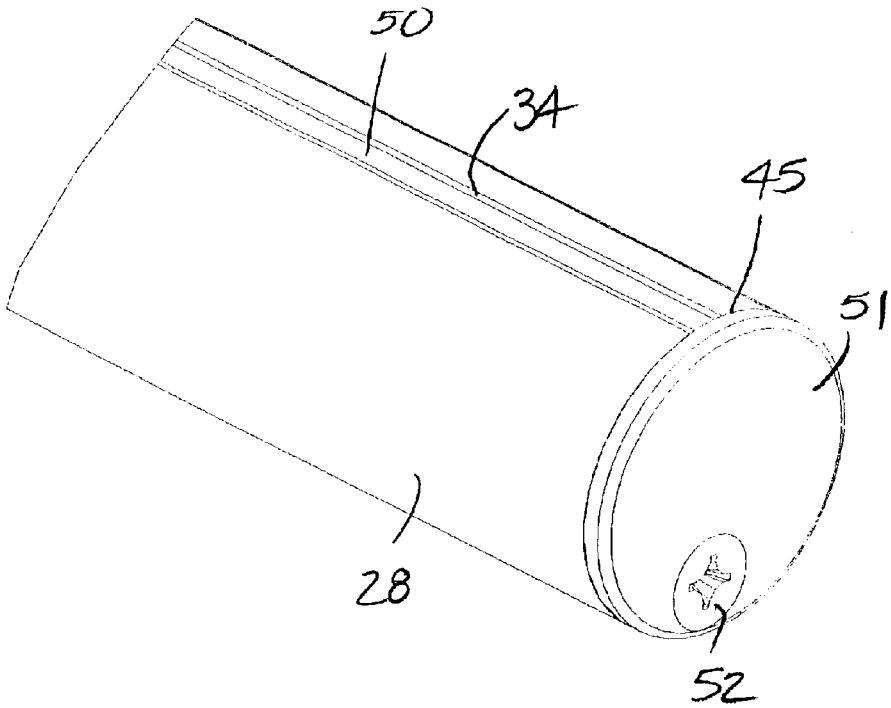
FIG. 5 is a perspective view showing the end cap of FIG. 4 secured to the hem bar.

The hem bar 28 further includes inwardly projecting members 49 within the interior 32 opposite the access slot 34. Referring to FIGS. 4 and 5, the weighting assembly 12 includes end caps 51 for closing the ends 45 of hem bar 28 following receipt of the spline 40 and rod 50 within the interior 32. The members 49 provide structure within the interior 32 for engagement by a fastening member, such as screw 52, to secure the end cap 51 to the hem bar 28. The end cap 51 includes an opening 53 for receipt of screw 52.

Figure 6:
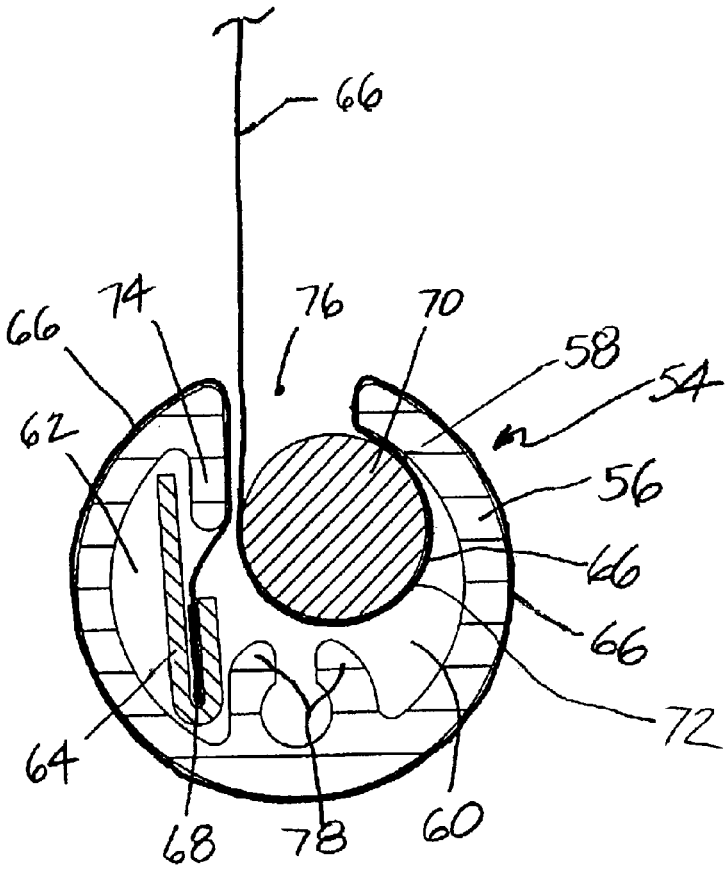
FIG. 6 is a partial sectional view of a roller shade fabric weighting assembly according to a second embodiment of the present invention.

Referring to FIG. 6, a weighting assembly 54 according to a second embodiment of the invention includes a hem bar 56. The hem bar 56 includes a circular wall 58 defining an interior 60. The hem bar 56 further includes a pocket 62 defined within the interior 60. In a similar fashion to the weighting assembly 12, the pocket 62 of hem bar 56 is adapted to slidingly receive a spline 64 secured to the terminal end 68 of a shade fabric 66. The weighting assembly 54 includes an elongated rod 70 slidingly received within a loop 72 formed by the fabric 66 within the interior 60 of hem bar 56. The rod 70 functions in a similar manner to rod 50 of weighting assembly 12 to apply a clamping force to secure the fabric 66 to the hem bar 56 upon release of the weighting assembly 54.

The relative size of hem bar 56 with respect to the associated spline 64 and rod 70 is smaller than that of hem bar 28 and its associated spline 40 and rod 50. To accommodate the relatively larger spline 64, the pocket 62 of hem bar 56 is defined in part by one of a pair of members 78 that form structure for securing an end cap in a similar manner to hem bar 28. A member 74 positioned adjacent 74 an access opening 76 also forms a part of the pocket 62. In a similar manner to weighting assembly 12, the release of the weighting assembly 54 will result in a downward movement of the hem bar 56 from the position of the hem bar shown in FIG. 6 directing rod 70 toward the access slot 76. Because of the positioning of the member 74 adjacent access slot 76, the rod 70 will contact member 74.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A weighted roller shade fabric comprising:

a flexible shade fabric;

a hem bar secured to the shade fabric such that a portion of the shade fabric wraps an outer surface of the hem bar and substantially encloses the hem bar to weight the fabric, the hem bar defining an interior cavity, the hem bar including a longitudinally extending slot through which a portion of the shade fabric adjacent to the substantially enclosing portion is received to form a loop within the interior cavity; and a securing member engaging the shade fabric within the interior cavity to secure the hem bar to the shade fabric adjacent the wrapping portion of the shade fabric without any visible seam, the securing member comprising an elongated rod received within the shade fabric loop, the rod wedging the shade fabric against an inner surface of the interior cavity adjacent the slot under load applied by the weight of the hem bar.

2. The weighted roller shade fabric according to claim 1 further comprising an elongated spline secured to the end of the shade fabric.

3. The weighted roller shade fabric according to claim 2, wherein the interior cavity of the hem bar comprises first and second portions and wherein the spline and rod are respectively located in the first and second portions of the interior cavity.

* * * * *